US006558248B1

(12) United States Patent
Moore, Jr. et al.

(10) Patent No.: US 6,558,248 B1
(45) Date of Patent: May 6, 2003

(54) OPENABLE SCREENED FLOOR VENT COVER

(75) Inventors: Fred D. Moore, Jr., Horsham, PA (US); Debra Reilly, King of Prussia, PA (US)

(73) Assignee: Comfort Creators, Inc., Collegeville, PA (US)

( * ) Notice: Subject to any disclaimer, the term of this patent is extended or adjusted under 35 U.S.C. 154(b) by 0 days.

(21) Appl. No.: 09/910,934

(22) Filed: Jul. 24, 2001

(51) Int. Cl.[7] ..... F24F 13/20
(52) U.S. Cl. ..... 454/289; 49/463; 160/106
(58) Field of Search ..... 454/289, 290, 454/370; 49/463; 160/106

(56) References Cited

U.S. PATENT DOCUMENTS

| | | | | | |
|---|---|---|---|---|---|
| 32,897 | A | | 7/1861 | Sexton | |
| 684,610 | A | * | 10/1901 | Marhske | 160/106 |
| 2,069,268 | A | * | 2/1937 | Otto | 160/106 |
| 2,080,726 | A | | 5/1937 | Lowinger | |
| 2,203,311 | A | | 6/1940 | Sinclair | |
| 2,557,566 | A | * | 6/1951 | Ronfeldt | 454/276 |
| 2,743,660 | A | | 5/1956 | Scherff | |
| 3,603,048 | A | * | 9/1971 | Hadfield et al. | 16/4 |
| 4,712,343 | A | * | 12/1987 | Dearling et al. | 454/370 |
| 4,856,493 | A | * | 8/1989 | Fleming et al. | 126/299 D |
| 5,213,543 | A | * | 5/1993 | Clarino | 292/253 |
| 5,462,382 | A | * | 10/1995 | Sauerwein et al. | 404/2 |
| 5,623,795 | A | * | 4/1997 | Padgett, Jr. | 185/47 |
| 5,720,660 | A | | 2/1998 | Benedetto et al. | 454/284 |
| 5,954,221 | A | | 9/1999 | Boland | 220/495.08 |
| 5,984,776 | A | | 11/1999 | Berger | 454/290 |
| 6,196,597 | B1 | | 3/2001 | Karnes | 285/331 |

* cited by examiner

*Primary Examiner*—Harold Joyce
(74) *Attorney, Agent, or Firm*—Drinker Biddle & Reath LLP

(57) ABSTRACT

An openable screened floor vent cover for use in preventing debris from entering a floor vent during construction is comprised of a board having a length and width larger than the vent to be covered. The board is provided with a cut substantially in the shape and size of the vent to be covered. A screen is attached to the periphery of a first surface of the board. The portion of the board within the cut is removable to enable air flow from the vent as desired during construction, and may be replaced when air flow from the vent is no longer needed. The board is nailed to the sub-flooring surrounding the vent. The cover may be removed after construction.

15 Claims, 2 Drawing Sheets

OPENABLE SCREENED FLOOR VENT COVER

FIELD OF THE INVENTION

The present invention relates to an apparatus for use in the construction of homes and buildings wherein a floor vent may be covered to prevent debris from entering the vent during construction, but selectively opened to allow the passage of air flow, such as heating or cooling air, as desired during construction.

BACKGROUND OF THE INVENTION

There has been a need in the field of construction to prevent debris from entering floor vents. This debris may be various types of objects including saw dust, small pieces of wood, pieces of dry wall, dirt, nails and various other debris generated during the construction process. This debris falls down into the floor vent and often times ends up in a portion of the duct where it could congest the duct and the floor vent. Such floor vents are difficult to clean out, and are often not adequately cleaned prior to the completion of the construction. Very often, air deflectors are placed over the vents and the debris remains in the vents.

Recently, this problem has been addressed by Karnes in U.S. Pat. No. 6,196,597 B1 wherein Karnes discloses a relatively complicated heating duct structure which includes a floor mounted elbow boot which is equipped with a removable plastic cover to prevent dust, dirt and debris from accumulating in the installed heating duct during finish construction of the building. However, this requires an expensive especially made floor mounted elbow boot which is equipped with this special duct cover. It is only available with the particular duct. It requires the molding of a particular plastic cover to exactly fit the particular duct.

SUMMARY OF THE INVENTION

The present invention provides numerous advantages including the fact that it is a relatively inexpensive item which may be used and disposed of after a single use. However, alternatively, the openable screened floor vent cover of the present invention may be reused on multiple occasions if so desired.

Briefly and basically, the present invention comprises an apparatus which includes a board having a length and a width larger than the vent to be covered. The board is provided with a first and a second surface with a screen secured to the periphery of the first surface of the board. The board is provided with a cut substantially in the shape and size of the vent to be covered. In use, the periphery of the board with the screen attached thereto is secured to the subfloor surrounding a vent during construction and the portion of the board within the cut is selectively removable to enable air flow from the vent as desired.

In a presently preferred embodiment, the board may be comprised of cardboard and preferably provided with a foil covering. However, it is understood that other suitable rigid and semi-rigid materials may be utilized to construct the board including wood or composite manufactured materials. Preferably, the screening may be stapled to the cardboard, or it may be applied adhesively or by any other type of fastener.

In a presently preferred embodiment, the cut in the shape of the vent is provided with tabs or indents to make removal of the central portion of the board easier. In an alternative embodiment, which is presently preferred, a second board element may be mounted about the periphery of the first board element and secured to the first surface of the first board and the intervening portion of the screen.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
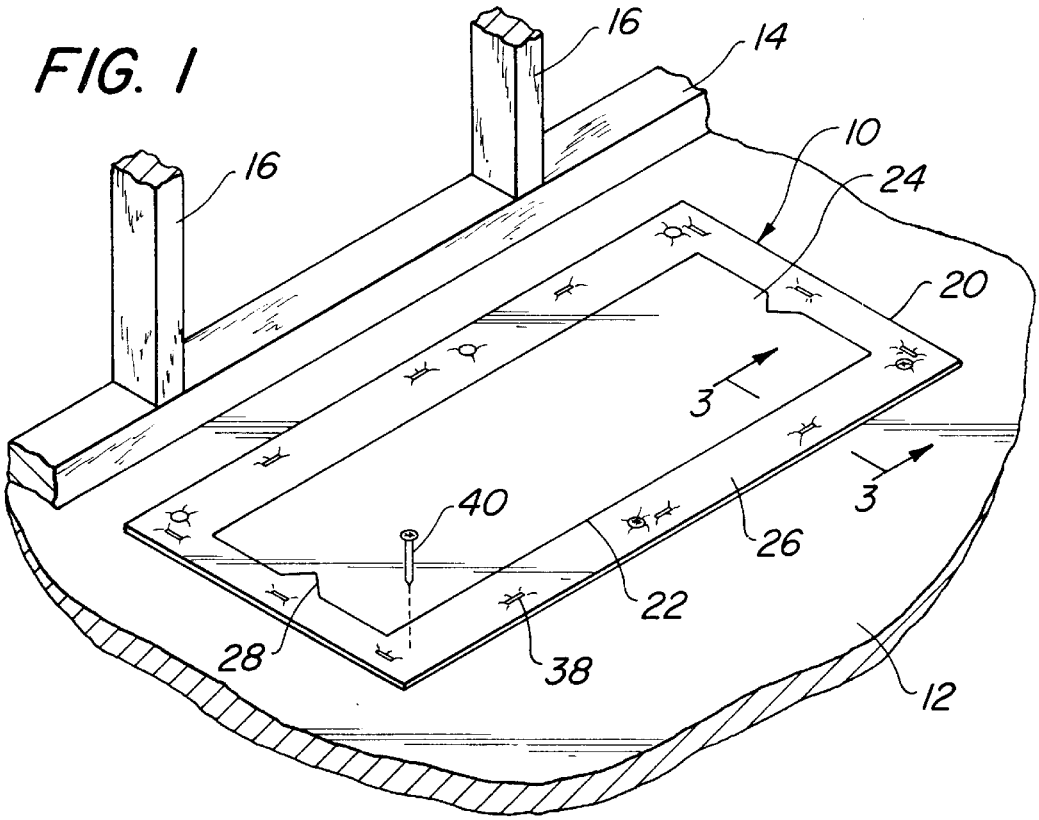
FIG. 1 is a view in perspective of an openable screened floor vent cover in accordance with the present invention being applied over subflooring to cover a vent.

Referring now to the drawings, wherein like numerals indicate like elements, there is shown in FIG. 1 an openable screened floor vent cover 10 in accordance with the present invention applied over the subflooring 12 of a building under construction. A typical base plate 14 and studs 16 are illustrated as a typical environment in which use may occur.

Figure 2:
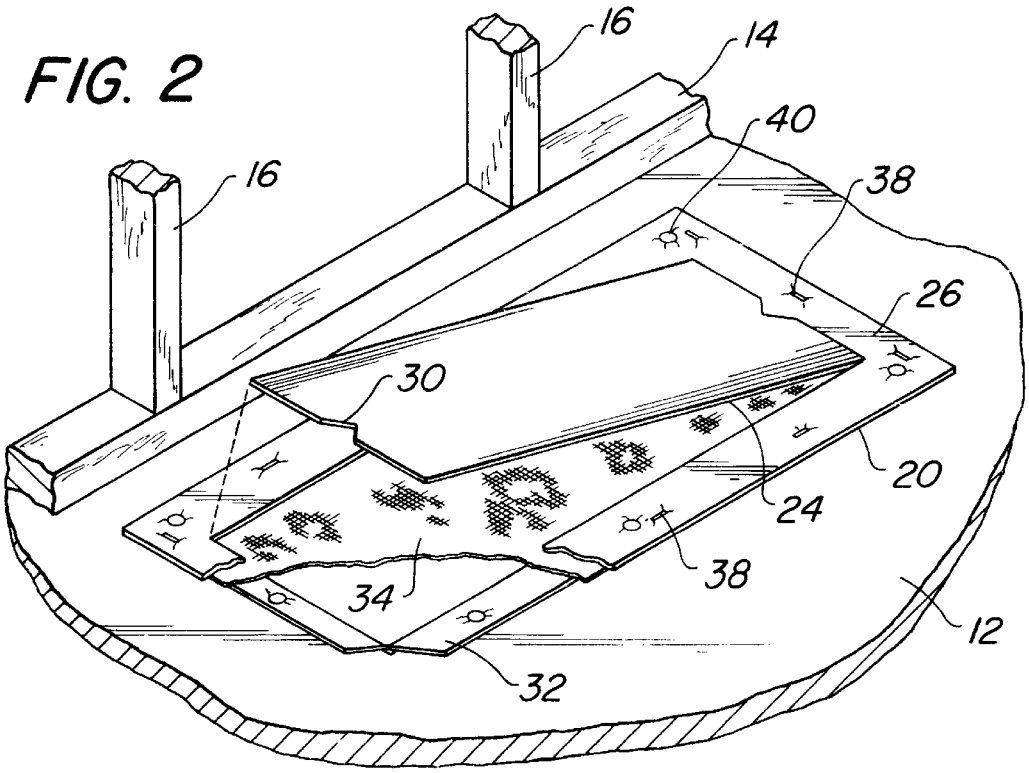
FIG. 2 is a view in perspective of the openable screened floor vent cover illustrating the removal of an insert surrounded by a cut in the board.
Figure 3:
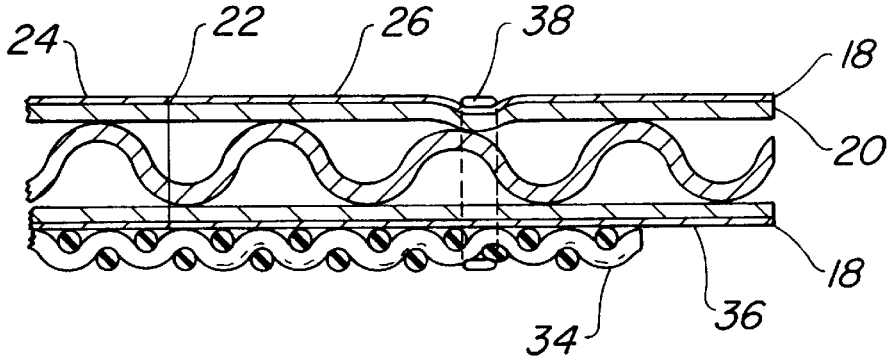
FIG. 3 is cross-sectional view taken along line 3—3 of FIG. 1.

As may be best seen from FIGS. 1, 2 and 3 taken together, the present invention is comprised of a board 20. Board 20 is provided with a length and a width larger than the vent to be covered. Board 20 may be constructed of any suitable rigid or semi-rigid material. In a presently preferred embodiment, board 20 may be constructed of relatively inexpensive cardboard. In a presently preferred embodiment, board 20 may be metalized or covered with a metallic foil 18 as shown in FIG. 3. Foil 18 may be aluminum or other suitable metal. Alternatively, board 20 may be covered with other suitable coverings, such as a synthetic plastic material which is impervious to moisture. However, metallic foil 18 is not necessary nor required. The cardboard with the metallic foil 18 is of the type that is commonly used in connection with duct work, such as that which is commercially available under the trademark "THERMOPAN," from Thermo Manufacturing, Inc. located at 3709 Columbus Road NE, Canton, Ohio 44705.

As best illustrated in FIGS. 1 and 2, board 20 is provided with a cut 22 substantially in the shape of a floor vent to be covered, but in view of the structure and operation of the present invention, the cut need not correspond exactly to the shape of the vent. In fact board 20 and cut 22 could be substantially larger than the size of the vent without any adverse effect in the use and operation of the openable screened floor vent cover of the present invention. Furthermore, cut 22 could be smaller than the vent as long as board 20 is larger than the vent and is attachable to the subflooring. Cut 22 is preferably a fine cut wherein the portion of the board 24 within cut 22 may be frictionally retained within a peripheral portion 26 of board 20, but also easily removed. For convenience, the portion of the board within the cut 24 may be referred to herein as the insert portion. To aid in the removal of insert portion 24 from the remainder of board 20, cut 22 may be provided with an indent 28 to provide tab or indent 30 on insert 24. Tab or indent 30 makes it easier for a worker to get his fingernail, tool or other lifting means under an edge of insert 24 to remove it. Insert 24 may be removed to allow air flow from vent 32 to provide heating air flow or cooling air flow from the vent as may be desired. Heating air flow is often required, particularly in cooler climates during the fall, winter and spring seasons when dry wall is being finished. It may also be required for other reasons. Cooling air flow may be required in warm or hot climates. Once there is no longer a need for air flow from the vent, insert 24 may be replaced within periphery 26 of board 20.

As best illustrated in FIGS. 2 and 3, board 20 is provided with a screen 34 mounted to a first surface 36 of board 20. Screen 34 is secured to first surface 36 of periphery 26 by staples 38. However, it is understood that screen 34 may be mounted to first surface 36 of board 20 by any suitable means such as adhesive, rivets or other fastening means.

In use, openable screened floor vent cover 10 is mounted over the subflooring as illustrated in FIGS. 1 and 2 by nails 40. However, any suitable means of securing openable screened floor vent cover 10 over the vent 32 and subflooring 12 may be utilized including staples, tacks, roofing nails, screws or the like. Once openable screened floor vent cover 10 is mounted over the subflooring 12 and vent 32, debris from the construction process, such as saw dust, wood chips, nails, vinyl and paper insulation removed from electrical wires, pieces of dry wall and the like are precluded from entering vent 32. When air flow is desired from the vent for various reasons, the portion of the board 24 within the cut 22 may be removed by inserting a fingernail, putty knife, screwdriver or the like into the cut and lifting insert 24 out from the periphery portion of the board 26 to enable air flow. As discussed above, indent or tab 30 in insert 24 may be helpful in this regard.

It is understood that insert tab 30 may be located at any suitable location. It is presently preferred on the shorter side of insert 24, but it could be positioned on the long side. Alternatively, tabs could be placed on all four sides or there could be multiple tabs on each side.

Even with insert 24 removed to allow air flow from the vent, screen 34 protects the vent opening by precluding anything from entering the vent other than dust or the very finest of debris. In other words, the screening 34 would still preclude nails, pieces of dry wall, wood chips, electrical insulation and other item from falling into the vent. Once there is no longer any need for air flow from vent 32, insert 24 may be reinserted within periphery 26 of the openable screened floor vent cover 10. Openable screened floor vent cover 10 may be removed after construction is complete. At this time openable screened floor vent cover 10 may be discarded as a disposable item or, if desired, may be reused on another construction job.

Figure 4:
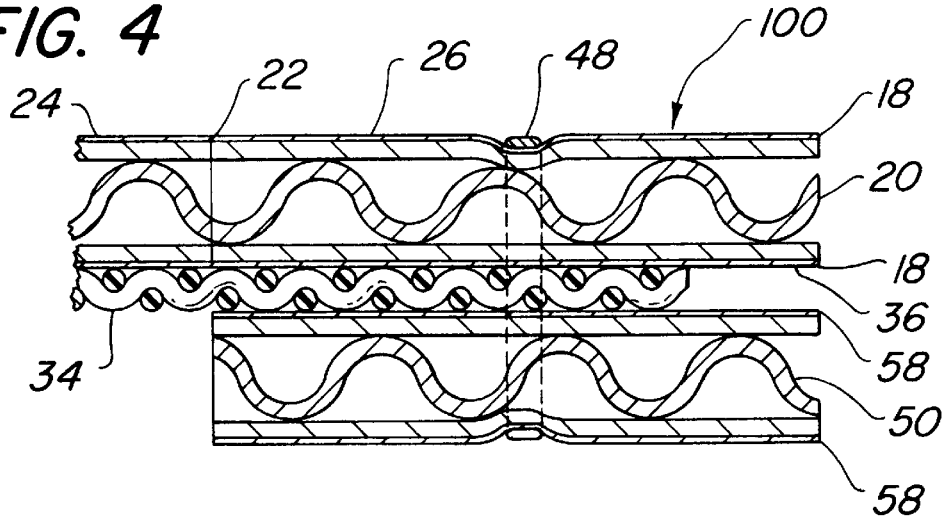
FIG. 4 is a cross-sectional view, corresponding to line 3—3 of FIG. 3 of another embodiment of the invention wherein the screening is sandwiched between the board and a board element.

Referring now to FIG. 4, there is shown another embodiment of the present invention wherein elements corresponding to those shown in FIGS. 1 through 3 are given the same reference numerals. In FIG. 4, openable screened floor vent cover 100 is provided with a second board element 50. Second board element 50 is shaped or formed or cut out to surround the vent opening corresponding to cut 22. Second board element 50 is secured to the periphery 26 of first surface 36 of board 20 including the intervening portion of screen 34. As with respect to FIGS. 1 through 3, this may be secured by a staple 48, by rivets, adhesive or any other suitable fastening means. As illustrated in FIG. 4, second board element 50 would preferably include metallic foil layers 58. However, metallic foil layers 58 are not necessary even if board 20 is provided with a foil or other covering. Further, board element 50 could be comprised of a different material, for example board 20 could be comprised of cardboard and board element 50 could be comprised of a thin layer of wood. The provision of second board element 50 is presently preferred as it provides additional rigidity for openable screened floor vent cover 100 and provides a cover for the free end of screen 34. However, if minimalization of cost is a prime criteria, second board element 50 is not necessary.

Figure 5:
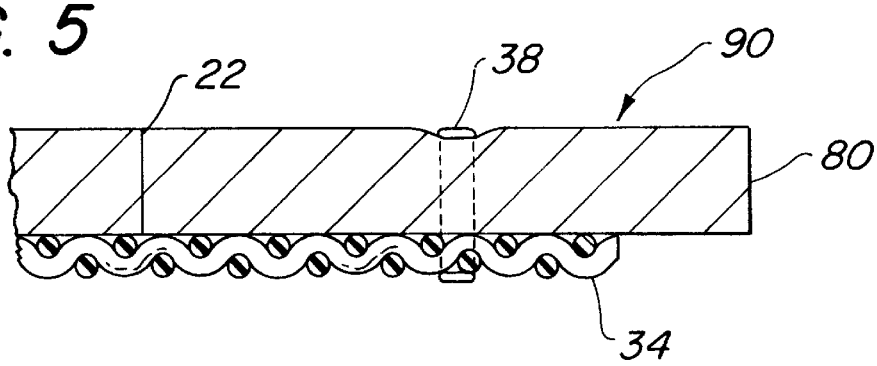
FIG. 5 is a cross-sectional view of the section corresponding to line 3—3 of FIG. 3 of another embodiment showing the board made of another material.

Referring now to FIG. 5, there is shown another embodiment of an openable screened floor vent cover 90 which is identical of that disclosed and described with respect to FIGS. 1 through 3, but it illustrates that the board may be made of other suitable materials including wood, composite manufactured materials or any other suitable material. The board in FIG. 5 is designated as 80 and the other elements are given the same numerals as in FIGS. 1 through 3.

The present invention may be embodied in other specific forms without departing from the spirit or essential attributes thereof and, accordingly, reference should be made to the appended claims, rather than to the foregoing specification as indicating the scope of the invention.

We claim:

1. A disposable cover for a conditioned air supply vent in the floor of a building under construction, the cover comprising:

(a) a board having a length and a width larger than the conditioned air supply vent to be covered, the board having a cut that divides the board into (1) a peripheral portion adapted to be secured to a subfloor surrounding the vent, and (2) a removable insert portion substantially in the shape and size of the vent; and (b) a screen secured to the peripheral portion of a first surface of the board.

2. A cover in accordance with claim 1 wherein said board is cardboard.

3. A cover in accordance with claim 1 wherein said board is comprised of wood.

4. A cover in accordance with claim 1 wherein said board is comprised of a composite material.

5. A cover in accordance with claim 1 wherein said screen is adhesively bonded to said peripheral portion of said board.

6. A cover in accordance with claim 1 wherein said screen is secured to said peripheral portion of said first surface of said board by fasteners.

7. A cover in accordance with claim 6 wherein said fasteners are staples.

8. A cover in accordance with claim 1 wherein said cut substantially in the shape of said vent is provided with tabs or indents.

9. A cover in accordance with claim 2 wherein said cardboard is provided with a covering.

10. A cover in accordance with claim 2 wherein said cardboard is provided with a foil covering.

11. A cover in accordance with claim 1 including a second board element, said second board element being shaped to surround said vent opening and being secured to the peripheral portion of said first surface of said board and an intervening portion of the screen.

12. A cover in accordance with claim 1 wherein said insert portion of said board, after it has been removed, may be replaced to close said vent as desired.

13. A floor vent cover comprising:

a board divided by a cut into a central insert portion and a peripheral portion, the central insert portion being frictionally but removably retained within the peripheral portion;

the insert portion being sized and shaped to allow air flow through a vent when the peripheral portion is attached to a floor surrounding the vent and the insert portion is removed from the peripheral portion; and a screen juxtaposed with the insert portion and attached to the peripheral portion.

14. A method of preventing debris from entering air ducts during construction of a building, the method comprising:

providing a floor vent cover comprising a board having a central insert portion removably engaged with a peripheral portion, and a screen attached to the peripheral portion;

mounting the floor vent cover over a vent and subflooring;

removing the insert portion when air flow from the vent is desired; and replacing the insert portion when air flow from the vent is no longer desired.

15. A method of preventing debris from entering air ducts during construction of a building, the method comprising:

providing a floor vent cover comprising a board having a central insert portion removably engaged with a peripheral portion and a screen attached to the peripheral portion;

mounting the floor vent cover over a vent and subflooring; and removing the insert portion when air flow from the vent is desired.

* * * * *